US006397827B1

(12) United States Patent
Kato et al.

(10) Patent No.: US 6,397,827 B1
(45) Date of Patent: Jun. 4, 2002

(54) SPARK IGNITION DEVICE FOR DIRECT INJECTION-TYPE ENGINES

(75) Inventors: Takehiko Kato, Gamagori; Tohru Yoshinaga, Okazaki; Hiroshi Yorita, Kariya; Shinichi Okabe, Okazaki; Tatsushi Nakashima, Anjo; Tetsuya Miwa, Nagoya, all of (JP)

(73) Assignee: Denso Corporation (JP)

( * ) Notice: Subject to any disclaimer, the term of this patent is extended or adjusted under 35 U.S.C. 154(b) by 9 days.

(21) Appl. No.: 09/630,009

(22) Filed: Jul. 31, 2000

(30) Foreign Application Priority Data

Aug. 2, 1999 (JP) ..... 11-218575
Feb. 16, 2000 (JP) ..... 2000-037548

(51) Int. Cl.[7] ..... F02P 15/10
(52) U.S. Cl. ..... 123/638; 123/620
(58) Field of Search ..... 123/638, 637, 123/295, 305, 430, 636, 607, 649, 606, 620; 315/209 CD

(56) References Cited

U.S. PATENT DOCUMENTS 3,926,165 A * 12/1975 Merrick
4,131,100 A * 12/1978 Merrick ..... 315/209 CD
4,326,493 A * 4/1982 Merrick ..... 123/606
5,056,496 A * 10/1991 Morino et al. ..... 123/604
5,211,147 A * 5/1993 Ward ..... 123/430
5,333,593 A * 8/1994 Morganti et al. ..... 123/637
5,476,084 A * 12/1995 Morganti et al. ..... 123/637
6,085,733 A * 7/2000 Motoyama et al. ..... 123/636
6,142,130 A * 11/2000 Ward ..... 123/606
6,176,216 B1 * 1/2001 Yamada et al. ..... 123/295
6,186,130 B1 * 2/2001 Skinner et al. ..... 123/637
6,283,104 B1 * 9/2001 Ito et al. ..... 123/637

FOREIGN PATENT DOCUMENTS

DE 100 37 528 * 3/2001 ..... F02P/5/15
JP 56-126671 10/1981
JP 63-138122 6/1988
JP 2001-108452 * 5/1999 ..... F02B/23/10
JP 2000-314341 * 11/2000 ..... F02D/43/00
JP 2001-107831 * 4/2001 ..... F02P/5/15

* cited by examiner

*Primary Examiner*—John Kwon
*Assistant Examiner*—Hieu T. Vo
(74) *Attorney, Agent, or Firm*—Nixon & Vanderhye PC

(57) ABSTRACT

An ignition device sets a total discharge period, each discharge period and each intermittent period of a multiple discharge are set by a control map in addition to the setting of a throttle opening, fuel injection timing, fuel injection period and ignition timing for the range of non-stratified charge combustion, when a direct injection-type engine operates in the range of stratified charge combustion. Ignition signals including a plurality of rises and falls are outputted in time with a specific ignition timing after fuel injection. Thus a plurality of sparks are generated from the spark plug, ensuring reliable ignition in response to changes in the concentration of sprayed fuel within the operation range for stratified charge combustion.

16 Claims, 12 Drawing Sheets

SPARK IGNITION DEVICE FOR DIRECT INJECTION-TYPE ENGINES

BACKGROUND OF THE INVENTION

This invention relates to a spark ignition device for improving fuel ignitability in a direct injection-type internal combustion engine in which fuel is directly injected into combustion chambers.

A spark ignition device capable of achieving improved fuel ignitability by the use of a multiple discharge system has been known. In this system, spark is intermittently discharged two or more times during each combustion cycle of the internal combustion engine.

In recent direct injection-type engines, stratified charge combustion is performed during engine operation under low load condition. That is, a stratified mixture in a form of lumps of sprayed fuel injected from an injector (a fuel injection valve) is moved along the contour of a combustion chamber and by the formation of an intake air stream on the top surface of the piston, thus forming a combustible mixture around a spark plug. It has been generally known that, even within the range of combustible mixture concentration at the plug gap of a spark plug, the combustible mixture in the stratified charge combustion is subject to variations in mixture concentration and ignition time depending upon operating conditions at that time, and that a necessary discharge energy for ignition varies with the mixture concentration.

The amount of discharge energy required in each pulse during aforethe multiple discharge, however, is not fully known. Therefore, the same amount of discharge energy as the amount of single discharge energy like in conventional spark ignition devices is supplied also during multiple discharge even in case of variations in stratified mixture. According to such a conventional method, however, a large amount of discharge energy is supplied even under a very ignitable mixture condition; that is, an excessive discharge energy is supplied. This results in an increase in the amount of electric energy consumed by the ignition system. This requires the use of a large-sized ignition coil and thereby lessens mountability of the spark plug in the internal combustion engine. Furthermore, the increased amount of discharge energy has an adverse effect upon wear resistance of electrodes of the spark plug and upon batteries, alternator, and engine output as well.

SUMMARY OF THE INVENTION

In view of the above-described disadvantages inherent in heretofore known spark ignition devices, it is an object of this invention to provide a spark ignition device capable of improving the condition of combustion, controlling discharge energy, and restraining upsizing of the ignition coil by changing the amount of each discharge energy in accordance with operating condition and by supplying the optimum amount of discharge energy in accordance with the condition of air-fuel mixture.

According to this invention, in order to perform multiple discharge under a part or all of the operating conditions of at least the stratified charge combustion in a direct injection-type injection engine, a high voltage is intermittently applied from an ignition coil for more than one time in a short time to generate sparks at a spark plug for more than one time, thereby ensuring reliable ignition in response to changes in the concentration of sprayed fuel supplied. Under operating conditions of other than the stratified charge combustion, and under operating conditions of the stratified charge combustion where multiple discharge is not effected, ignition of sprayed fuel is reliably achieved by generating at least one spark at spark plug electrodes. Reliably igniting the sprayed fuel is ensured by generating sparks to the sprayed fuel at a predetermined timing for a number of times suitable to a part or all of the operating conditions of stratified charge combustion in the direct injection-type engine and other operating conditions.

Since the intermittent multiple discharging period is set to gradually increase, the discharge energy for ignition of sprayed fuel can be preferably accumulated even immediately before the end of multiple discharge.

DETAILED DESCRIPTION OF THE PREFERRED EMBODIMENTS

Preferred embodiments of a spark ignition device according to this invention will be described with reference to the accompanying drawings.

Figure 1:
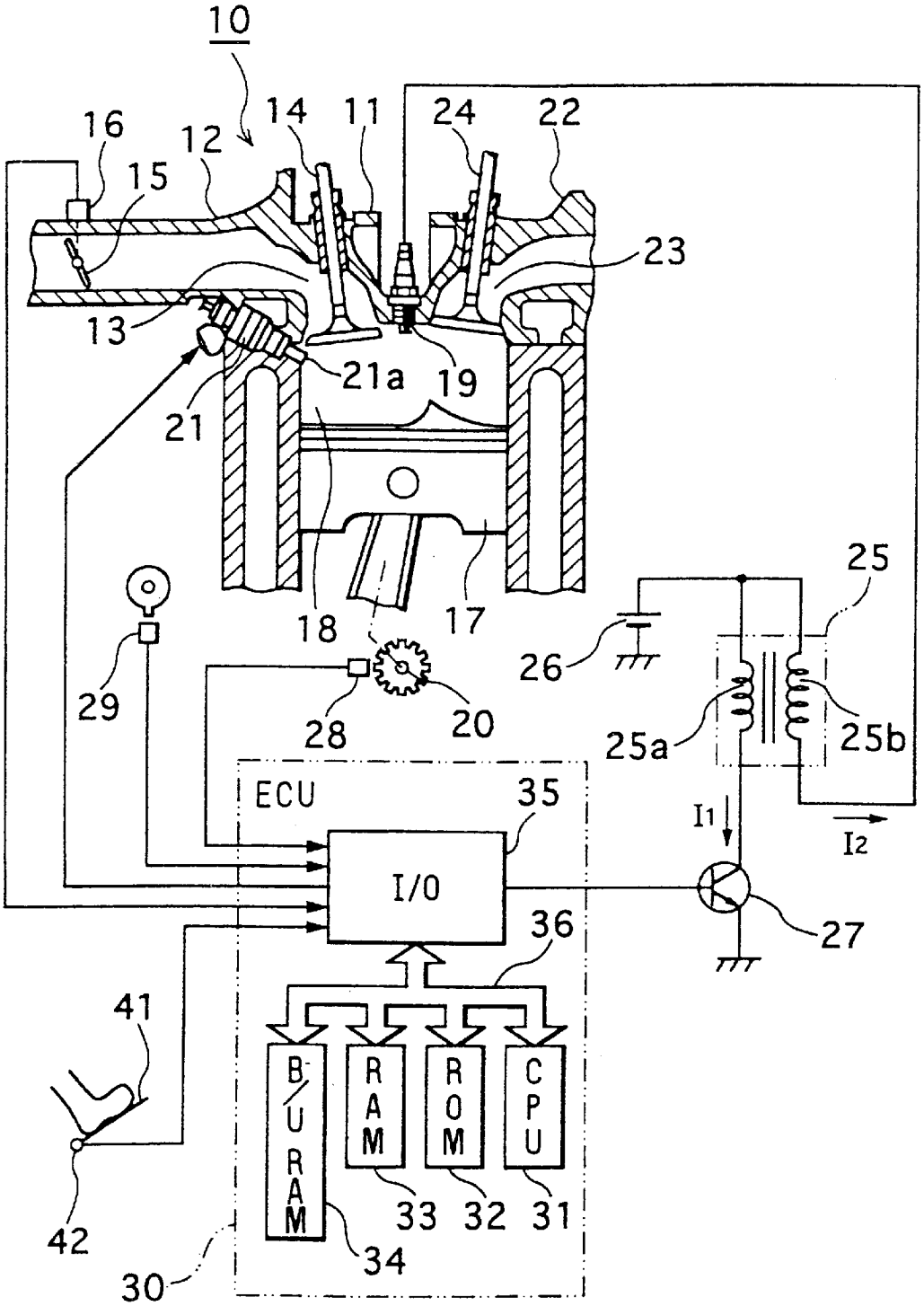
FIG. 1 is a schematic block diagram showing a direct injection-type engine to which one embodiment of a spark ignition device according to this invention is applied.
Figure 2:
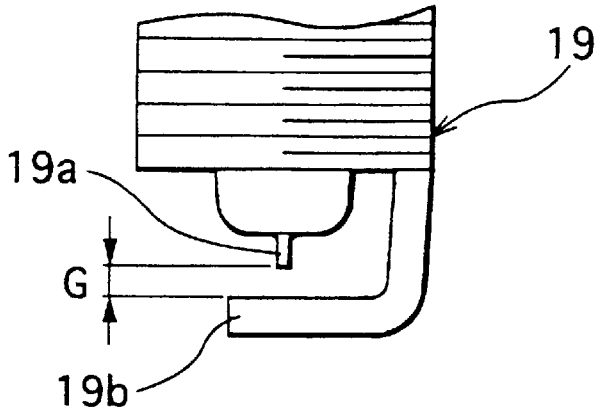
FIG. 2 is an enlarged view showing the shape of the forward end of a spark plug shown in FIG. 1.

FIG. 1 is a schematic block diagram showing a direct injection-type engine as an internal combustion engine to which one embodiment of the spark ignition device according to this invention is applied. FIG. 2 is an enlarged view showing the shape of the forward end of a spark plug shown in FIG. 1.

In FIG. 1 and FIG. 2, an intake air passage 12 is connected to a cylinder head 11 of a direct injection-type engine (direct injection gasoline engine) in which fuel is directly injected into each cylinder. On the downstream side of the intake air passage 12 is formed an intake port 13, in which an intake valve 14 is located. On the upstream side of the intake air passage 12 is located a throttle valve 15. The amount of throttle opening TA of this throttle valve 15 is regulated by electric current being controlled by a later-described ECU (Electronic Control unit) 30 in accordance with the amount of accelerator position AP fed from an accelerator position sensor 42 which detects the amount of depression of an accelerator pedal 41, being detected by a throttle opening sensor 16. The air that has been drawn in through the throttle valve 15 flows in through the intake port 13 when the intake valve 14 is open, being supplied into a combustion chamber 18 formed by the cylinder head 11 and a piston 17.

In the top portion of the cylinder head 11 of the direct injection-type engine 10 is located a spark plug 19 directed toward a combustion chamber 18. Furthermore, an injector 21 is mounted on the side of the cylinder head 11 of the direct injection-type engine 10. An injection nozzle 21*a* protrudes into the combustion chamber 18. High-pressure fuel pressurized by a high-pressure fuel pump (not shown) is supplied to the injector 21, being directly injected into the combustion chamber 18 at the valve opening timing of the injector 21. The high-pressure fuel directly injected into the combustion chamber 18 is mixed with the air being drawn through the intake valve 14. The the air-fuel mixture is ignited to burn by a spark generated at the spark-plug gap G between a center electrode 19*a* and a ground electrode 19*b* of the spark plug 19.

An exhaust air passage 22 is connected to the cylinder head 11 of the direct injection-type engine 10. In this exhaust air passage 22 is formed with an exhaust port 23, in which an exhaust valve 24 is located. Exhaust gases in the combustion chamber 18 are discharged to the exhaust air passage 22 side through the exhaust port 23 when the exhaust valve 24 is open.

To the center electrode 19*a* of the spark plug 19 is connected one end of a secondary winding 25*b* of an ignition coil 25. A primary winding 25*a* of the ignition coil 25 is connected at one end to a battery 26, and at the other end to the collector side of a power transistor 27. During operation of the direct injection-type engine 10, a power transistor 27 is turned on and off on the basis of an ignition signal (pulse signal) outputted to the base side of the power transistor 27 from the ECU 30, thereby making and breaking the circuit of the primary current I1 flowing in the primary winding 25*a* of the ignition coil 25 from the battery 26. Then, with the fall of the ignition signal IGt, the power transistor 27 is turned off to interrupt the primary current I1 flowing in the primary winding 25*a* of the ignition coil 25, thus generating on the primary side a counter electromotive force in response to the primary current I1. The secondary voltage V2 is generated by the secondary current I2 induced by the counter electromagnetic force. To the secondary winding 25*b* side of the ignition coil 25, the secondary current I2 flows. The high secondary voltage V2 corresponding to the turn ratio of the primary winding 25*a* and secondary winding 25*b* of the ignition coil 25 is applied to the spark plug 19, generating a spark in the plug gap G.

The ECU 30 is a logical operation circuit comprising a CPU 31 as a known central processing unit, a ROM 32 storing a control program and control map, a RAM 33 storing various data, a B/U (backup) RAM 34, an I/O (input/output) circuit, and a bus line 36 connecting these devices. Various sensor signals such as an accelerator position AP [°] from the accelerator position sensor 42, a throttle opening TA [0] from the throttle opening sensor 16, a crank angle θ1 [°CA] from a crank angle sensor 28 mounted on a crankshaft 20 of the direct injection-type engine 10, and a cam angle θ2 [°CA] from a cam angle sensor 29 mounted on a camshaft (not shown) are inputted.

Figure 4:
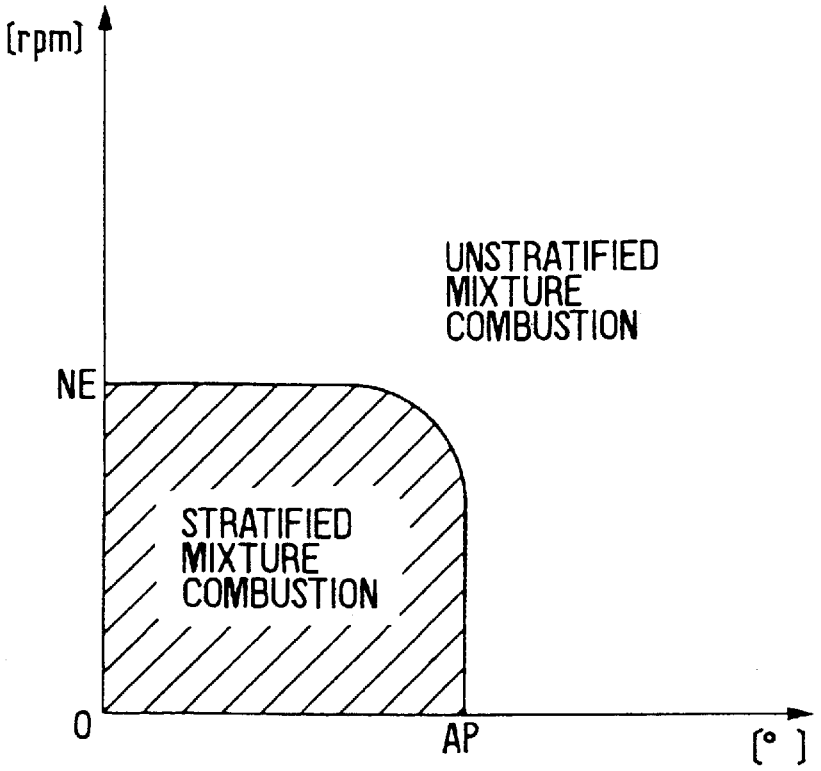
FIG. 4 is a map, in the embodiment, for determining the stratified charge combustion or non-stratified charge combustion on the basis of engine speed and accelerator position.

Next, by reference to FIG. 4, the routine shown in the flow chart of FIG. 3 for processing fuel injection and ignition timing control of the direct injection-type engine by the CPU 31 of the ECU 30 adopted in one embodiment of the spark ignition device will be explained. FIG. 4 shows a map for determining if the mixture combustion is being effected within the stratified charge combustion range or non-stratified charge combustion. The fuel injection/ignition timing control routine is repetitively performed by the CPU 31 at every given time.

Figure 3:
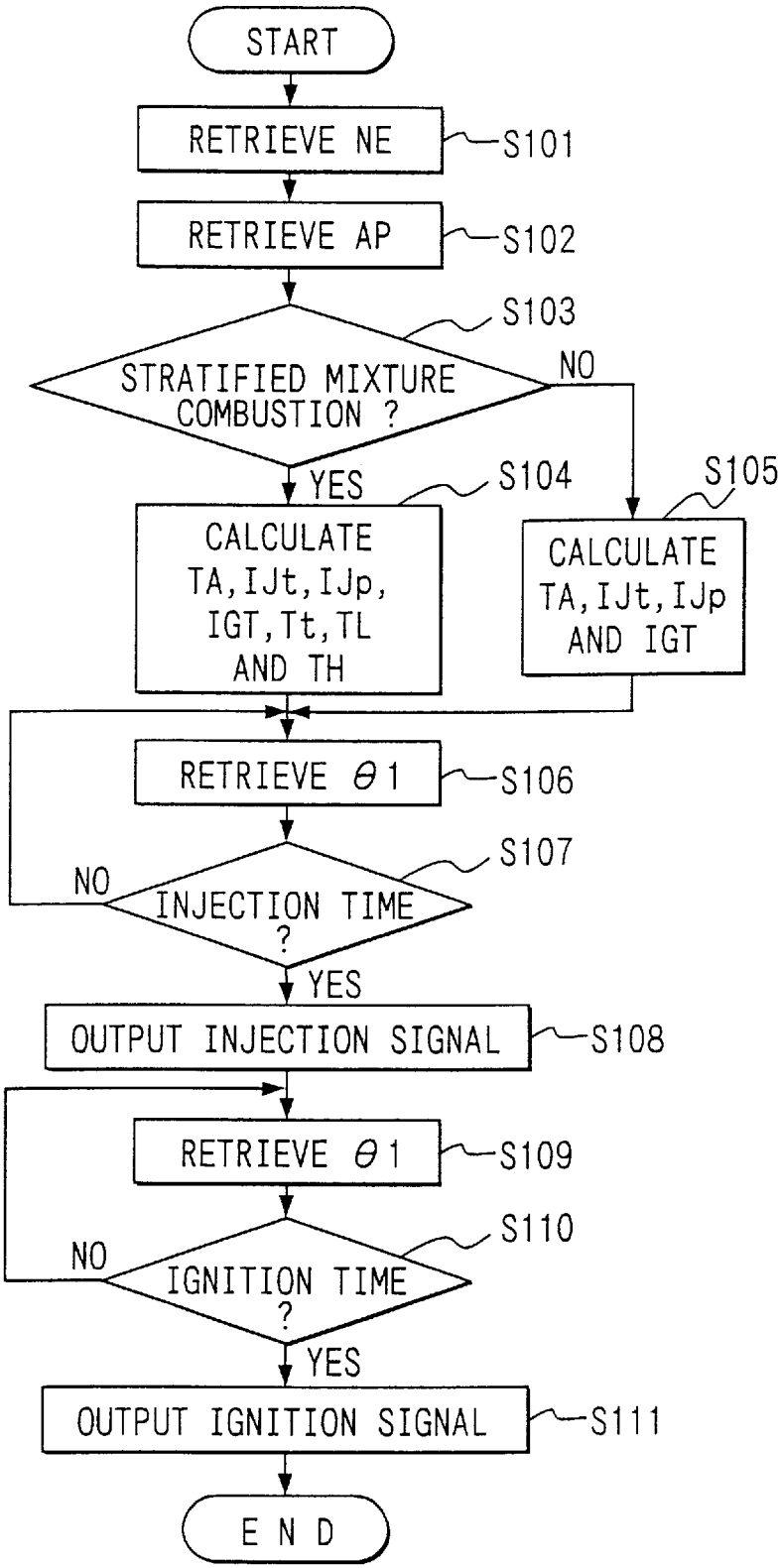
FIG. 3 is a flow chart showing a routine for processing fuel injection and ignition timing control by an ECU adopted in the embodiment of this invention in relation to the direct injection-type engine;.

First, at step S101 in FIG. 3, an engine speed NE is read in on the basis of the crank angle θ1 fed from the crank angle sensor 28. Next, at step S102, the accelerator position AP from the accelerator position sensor 42 is read in as an engine load. Then, at step S103, it is determined whether mixture combustion is effected within the stratified charge combustion range which is a mixture combustion range for a low engine load. When the required conditions at step S103 are established, that is, when the engine load is low, within the stratified charge combustion range as determined by the engine speed NE and the accelerator position AP as shown in FIG. 4, under which condition multiple discharge can be applied, the routine proceeds to step S104. At step S104, using the parameters such as the engine speed NE and the accelerator position AP, the throttle opening TA, fuel injection timing Ijt, fuel injection period IJp, ignition timing IGT, total discharge period Tt from the start to end of multiple discharge, each discharge period TL, and each intermittent period TH are calculated by a control map (not. shown) which has been prestored in the ROM 32.

On the other hand, where the required conditions of step S103 are not established, that is, when the engine load is high and, as shown in FIG. 4, when the combustion range determined by the engine speed NE and the accelerator position AP is outside of the condition where multiple discharge within the stratified charge combustion range is applied, or within the non-stratified charge combustion range, the routine proceeds to step S105. At step S105, the throttle opening TA, fuel injection timing IJt, fuel injection period IJp, and ignition timing IGT are calculated on the basis of such parameters as the engine speed NE and the accelerator position AP by the use of the control map (not shown) prestored in the ROM 32. Subsequently to step S104 or step S105, the routine proceeds to step S106, where the present crank angle θ1 [°CA] is read in from the crank angle sensor 28. Next, at step S107 the fuel injection timing is determined. Where the required conditions at step S107 are not established, that is, when the fuel injection timing is not determined, the routine goes back to step S106, where the same processing is repeated.

After the establishment of the required conditions at step S107, that is, when the fuel injection timing is determined, the processing proceeds to step S108, at which the fuel injection signal based on the fuel injection timing and fuel injection period calculated at step S104 or step S105 is outputted to the injector 21. Subsequently, at step S109, the present crank angle θ1 [°CA] from the crank angle sensor 28 is read in. Then, at step S110, the ignition timing is output. In case the required conditions are not established, that is, if the ignition timing is premature, the processing goes back to step S109, where the same processing is repeated. Then, when the required conditions at step S110 are established, that is, in the case of the ignition timing calculated at step S104 or step S105, the routine goes to step S111. At this time, when there exists the range of stratified charge combustion, the ignition signal IGt for multiple discharge is outputted to the power transistor 27 on the basis of the total discharge period, each discharge period, and each intermittent period that are calculated at step S104. On the other hand, if there exists the range of non-stratified charge combustion at this time, the ignition signal IGt for single discharge is outputted to the power transistor 27, thus completing the present routine.

Figure 5:
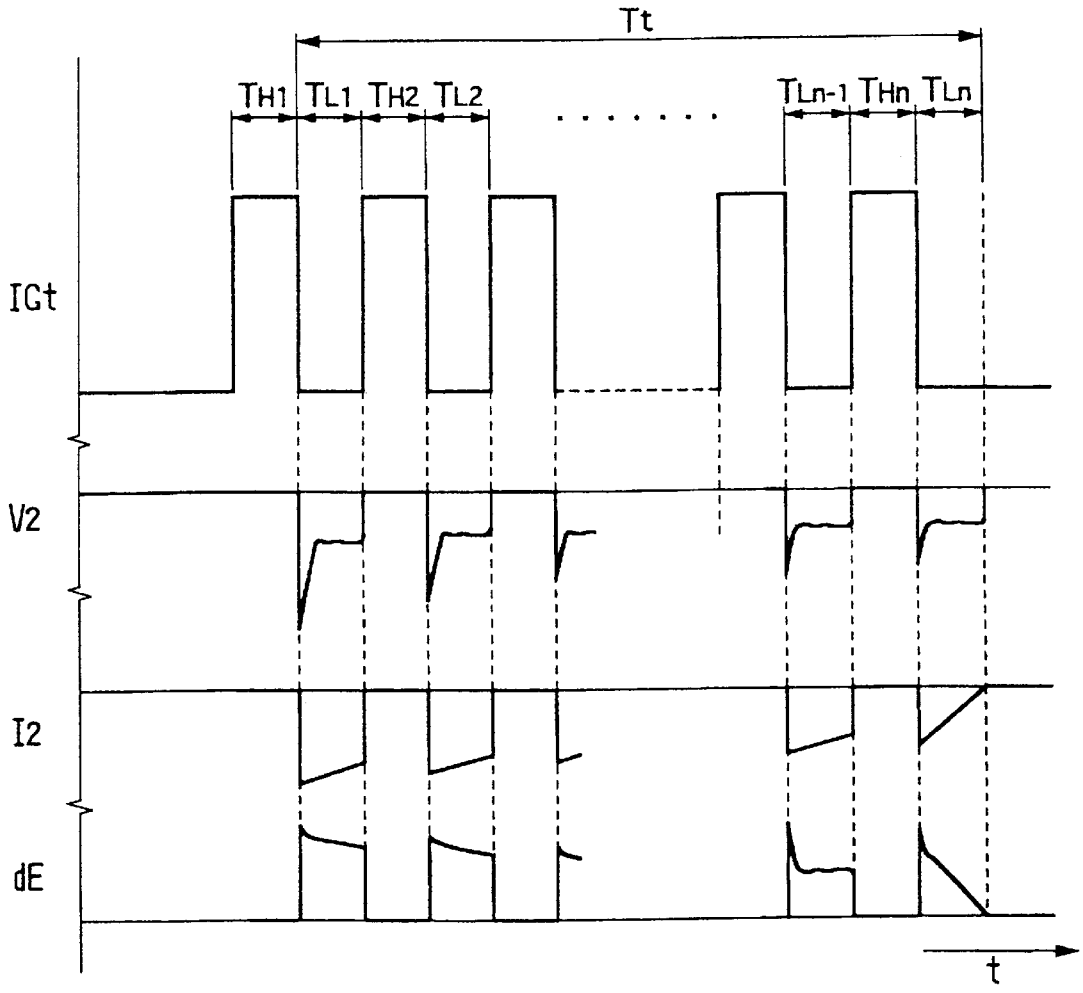
FIG. 5 is a time chart, in the embodiment, showing the state of transition of ignition signal, secondary voltage, secondary current, and discharging energy density during operation under the combustion of stratified mixture.

Next, the setting of the total discharge period, each discharge period, and each intermittent discharge period, according to step S104 in fuel injection/ignition timing control routine, will be explained with reference to the time chart in FIG. 5. FIG. 5 shows the state of transition of the ignition signal IGt, secondary voltage V2, secondary current I2, and discharge energy density dE during multiple discharge within the stratified charge combustion range.

As shown in FIG. 5, the ignition signal IGt is outputted from the ECU 30 to the power transistor 27 during multiple discharge. The power transistor 27 is turned on during the period when the ignition signal IGt is at a high level, and the primary current I1 flows from the battery 26 to the primary winding 25*a* of the ignition coil 25, thus storing the ignition energy. Then, when the ignition signal IGt falls to a low level, the power transistor 27 is turned off, allowing the ignition energy stored in the ignition coil 25 to, be discharged through the secondary winding 25*b*. Thus the secondary current I2 flows, thereby applying the high voltage secondary voltage V2 to the ignition plug 19.

Therefore, the longer the intermittent period TH1, . . . , THn during which the ignition signal IGt shown in FIG. 5 is supplied at a high level, the greater amount of discharge energy is achievable during the discharge period TL1, . . . , TLn, increasing the discharge energy density dE. Because of this increased discharge energy density dE, it becomes possible to set a long-period single discharge. Therefore, the total discharge period Tt for multiple discharge is set at 3 [ms] maximum, and the intermittent period TH2, . . . , THn at 1 [ms] maximum.

In this embodiment, the discharge was effected at the same discharge energy density per discharge during the total discharge period Tt. It should be noted, however, that, in this case, the intermittent period TH1 immediately before the total discharge period Tt or the final intermittent period THn may be set long so that the mixture will be discharged at a high discharge energy density during the initial period of discharge or immediately before the end of discharge. When the mixture is discharged at a high energy density during the initial period of discharge, ignition can occur at a high probability during the initial discharge period TL1 in the total discharge period Tt, resulting in a decreased variation of the ignition timing and accordingly in a stabilized state of combustion.

Next, an advantage provided by the high discharge energy density immediately before the end of discharge will be described.

When the direct injection-type engine 1 is operating within the stratified charge combustion range, the air-fuel mixture around the plug gap G of the spark plug 19 tends to be lean with the lapse of time, becoming hard to ignite. Therefore, a higher discharge energy density is required to ignite the mixture that failed to ignite at the initial period of multiple discharge.

According to the experimental research, the minimum discharge energy density required for ignition was 18 [mJ/ms], which depends on operating conditions though, and the length of discharge period required for ignition was 0.05 [ms]. Therefore, the intermittent period TH1, . . . , THn is determined by the operating conditions of the direct injection-type engine 1 (engine speed NE, accelerator position AP, etc.).

It was verified that the 3[ms] long continuous discharge makes it possible to reliably ignite the mixture under any operating conditions of the direct injection-type engine 1. In some direct injection-type engines used as an example, however, the discharge period and intermittent discharge period which depend on the operating conditions of the engine require to be controlled. For example, under low-load, low-speed operating conditions, during multiple discharge when the total discharge period Tt was 3 [ms], at the discharge energy density dE of 18 [mj/ms] for single discharge, at the discharge period of 0.05 [ms], and at the intermittent discharge period of 1 [ms] or less, the same effect could be achieved as in the case of the long-time continuous discharge. Also, under the operating conditions with both engine load and speed increased, the discharge period was around 0.5 [ms] and the intermittent discharge period was around 0.4 [ms].

In the meantime, at 30 [mJ/ms] or more discharge energy density dE required for single spark discharge, no higher ignition probability could be obtained. Therefore, it is understood that the discharge energy density dE to be set for multiple discharge should be 30 [mJ/ms] or more.

In the present embodiment, therefore, when the engine load of the direct injection-type engine is low under a part or all of the operating conditions for stratified charge combustion, a high voltage is applied intermittently to the ignition coil to perform multiple discharge in a short period of time, thus generating sparks two or more times at the spark plug 19 to thereby enable reliable ignition notwithstanding temperature changes of the sprayed fuel. Furthermore, under other operating conditions than the operating conditions for stratified charge combustion, the high voltage is applied one time from the ignition coil to effect a single discharge, that is, to generate a single spark at the spark plug 19, thus reliably igniting the sprayed fuel. That is, sparks fly to the sprayed fuel at a specific timing for a suitable number of times for a part or all of the operating conditions for stratified charge combustion or for other operating conditions of the direct injection-type engine 10, thereby ensuring reliable ignition to the sprayed fuel.

The ECU 30 calculates a changeover between multiple discharge and single discharge, total discharge period Tt from the start to end of multiple discharge, each discharge period TL1, . . . , TLn, and each intermittent period TH2, . . . , THn, on the basis of the control map stored in the ROM 32 preset for each operating condition of the direct injection-type engine 10. That is, the control map stored in the ROM 32 is used, by referring to the operating conditions of the direct injection-type engine 10 as parameters, for the calculation of the total discharge period, each discharge period, and each intermittent period that will be required for a changeover between multiple discharge for stratified charge combustion and single discharge for other operating conditions of the engine, and also for the repetition of rise and fall of the ignition signal IGt which forms a control pulse in multiple discharge. By thus using the pre-stored control map, the changeover of the operating conditions for mixture combustion can be accomplished quickly and properly. Furthermore the total discharge period, each discharge period, and each intermittent discharge period for multiple discharge can be set instantly, thereby enabling proper ignition control and accordingly satisfactory ignition.

In the present embodiment, the total discharge period Tt in multiple discharge is set within the range of 1.0 to 3.0 [ms] in accordance with the operating conditions of the direct injection-type engine 10. Thus it becomes possible to supply sufficient discharge energy for ignition notwithstanding a variation in the time of mixture formation in multiple discharge and a variation in the mixture concentration. Furthermore, it is possible to reduce electric energy consumption in the ignition system.

Furthermore, each discharge period TL1, . . . , TLn in multiple discharge is set within the range of 0.05 to 0.5 [ms] in accordance with the operating conditions of the direct injection-type engine 10, thereby enabling proper control of the amount of discharge energy each time of discharge in the multiple discharging operation.

Each intermittent period TH2, . . . , THn in multiple discharge is set within the range of 0.1 to 1.0 [ms] in accordance with the operating conditions of the direct injection-type engine 10, thereby enabling proper control of the amount of discharge energy each time in multiple discharge.

Next, the discharge energy density dE in each discharge period TL1, . . . , TLn of the total discharge period Tt in the multiple discharging operation is set to 18 [mJ/ms] or more which is the lower limit for igniting the sprayed fuel by the spark plug in accordance with the operating conditions of the direct injection-type engine 10. Thus it becomes possible to generate a spark to ignite the fuel under the operating conditions of stratified charge combustion and at the same time to reduce electric energy consumption in the ignition system.

The ECU 30 operates to make and break the circuit of the primary current I1 of the ignition coil 25, thereby generating a spark at the plug gap G of the spark plug 19 to perform multiple discharge. By thus performing multiple discharge in the vicinity of the top dead center of compression stroke in one combustion cycle of the direct injection-type engine 10, reliable ignition is accomplished in response to variations in the mixture concentration of the sprayed fuel.

Figure 6:
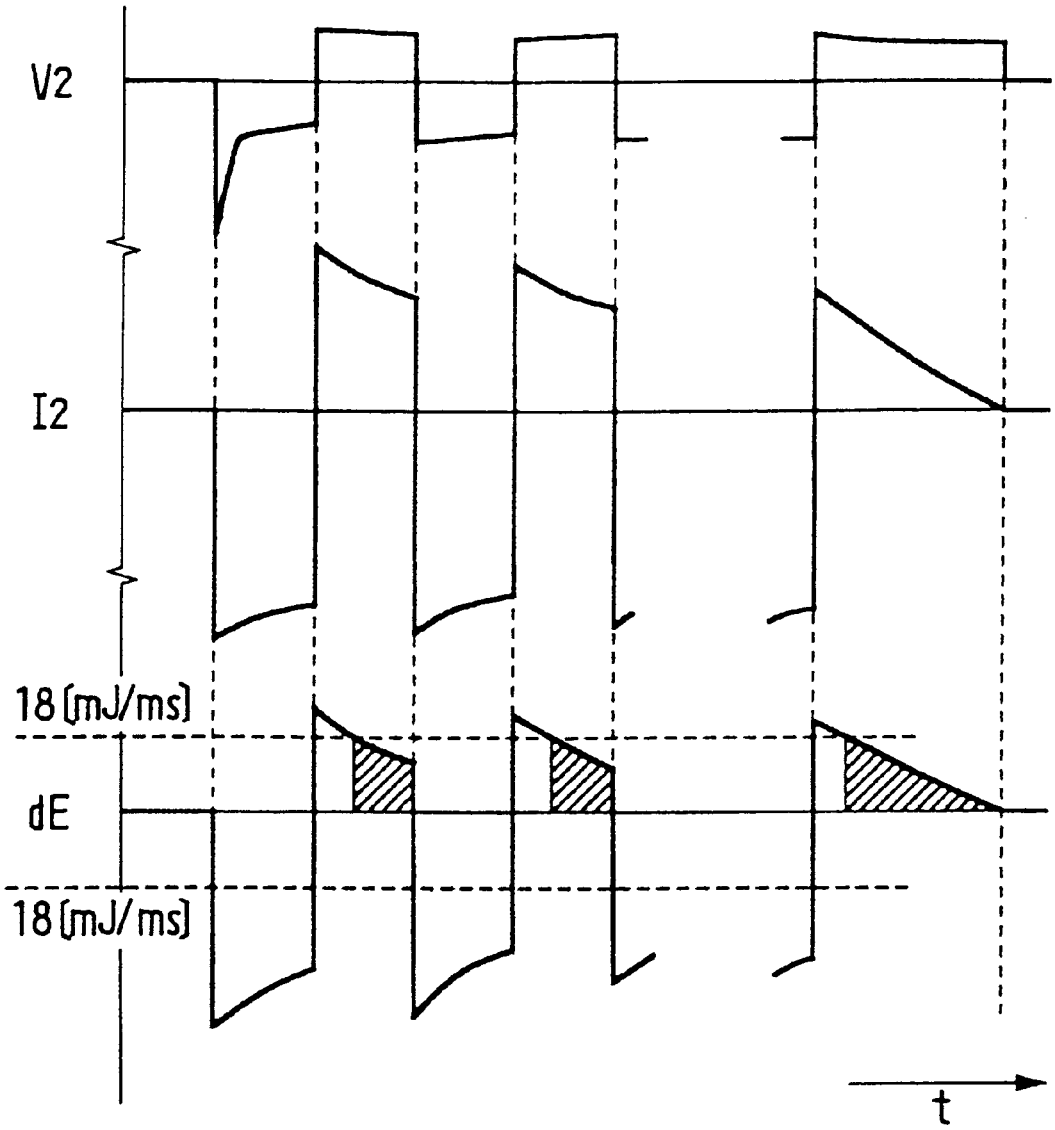
FIG. 6 is a time chart, in the embodiment, showing a variation of the state of transition of ignition signal, secondary voltage, secondary current, and discharging energy density under the combustion of stratified mixture.

In addition, to insure proper control of the amount of discharge energy for each discharge, continuous discharge effected by multiple discharge as shown in FIG. 6 is regarded and counted as discharge taking place during an intermittent discharge period of multiple discharge if the discharge energy density dE during the period is less than 18 [mJ/ms]. That is, when the discharge energy density dE is under 18 [mJ/ms] indicated by oblique lines in FIG. 6, the discharge period should be set within the range of 0.1 to 1.0 [ms].

In the above embodiment, it is to be noted that each discharge period TL and the intermittent period TH may be set at different lengths. For example, the length of the intermittent period TH2, . . . , THn may be set in relation to the discharge period TL1, . . . , TLn so that the amount of discharge energy per unit time [ms] during the initial period of discharge or immediately before the end of discharge in multiple discharge will be 30 [mJ] or more and the amount of discharge energy per unit time [ms] during the middle period of discharge will be 18 [mJ] or more.

Figure 7:
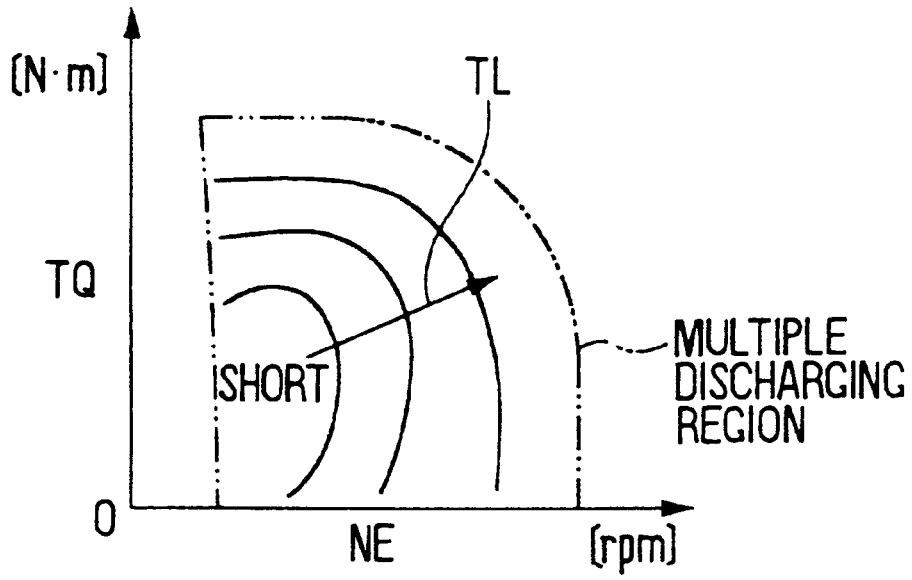
FIG. 7 is a characteristic diagram, in the embodiment, showing the length of discharge period within the range of application of multiple discharge, using engine speed and required torque as parameters.
Figure 8:
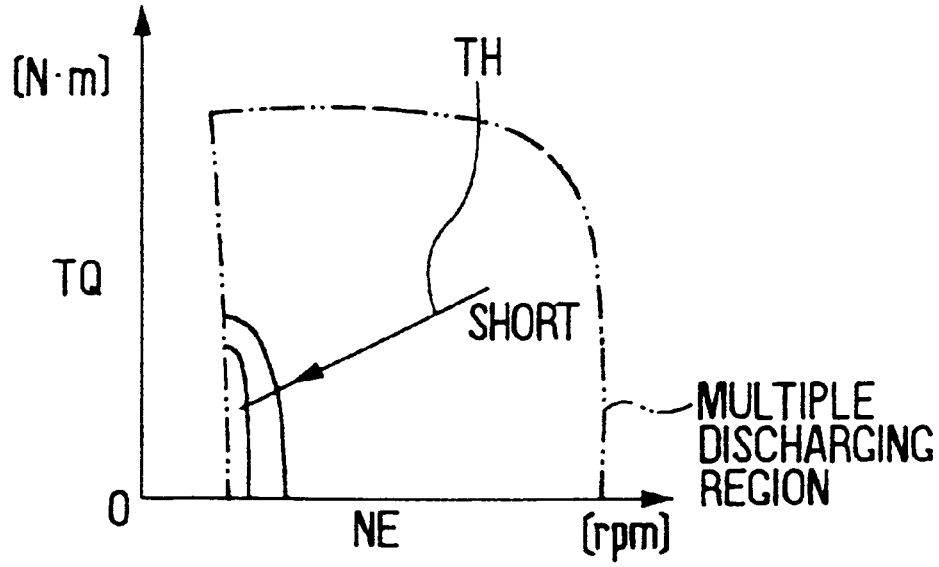
FIG. 8 is a characteristic diagram, in one embodiment, showing the length of intermittent discharge period within the range of application of multiple discharge, using engine speed and required torque as parameters.

At this time, as shown in FIG. 7 for example, the discharge period TL and the intermittent period TH are set so that the greater the engine speed NE and the required torque TQ as parameters, the longer the discharge period TL within the range of application of multiple discharge will be. Also as shown in FIG. 8 for example, the intermittent period TH is set so that the greater such parameters as the engine speed NE and the required torque TQ, the shorter the intermittent period TH within the range of application of multiple discharge will become.

By thus setting the discharge energy density during the initial period of discharge or immediately before the end of discharge in multiple discharge, it is possible to reduce the electric energy consumption in the ignition system while reliably igniting the sprayed fuel by a plug spark during the initial period of discharge or immediately before the end of discharge. Also it is possible to insure igniting the sprayed fuel by a spark at the middle period of discharge by keeping the discharge energy density at the lower limit or higher for igniting the sprayed fuel by a spark at the middle period of discharge. Therefore, reliably igniting the sprayed fuel is insured while reducing the electric energy consumption of the ignition system in the total discharge period during stratified charge combustion.

Figure 9:
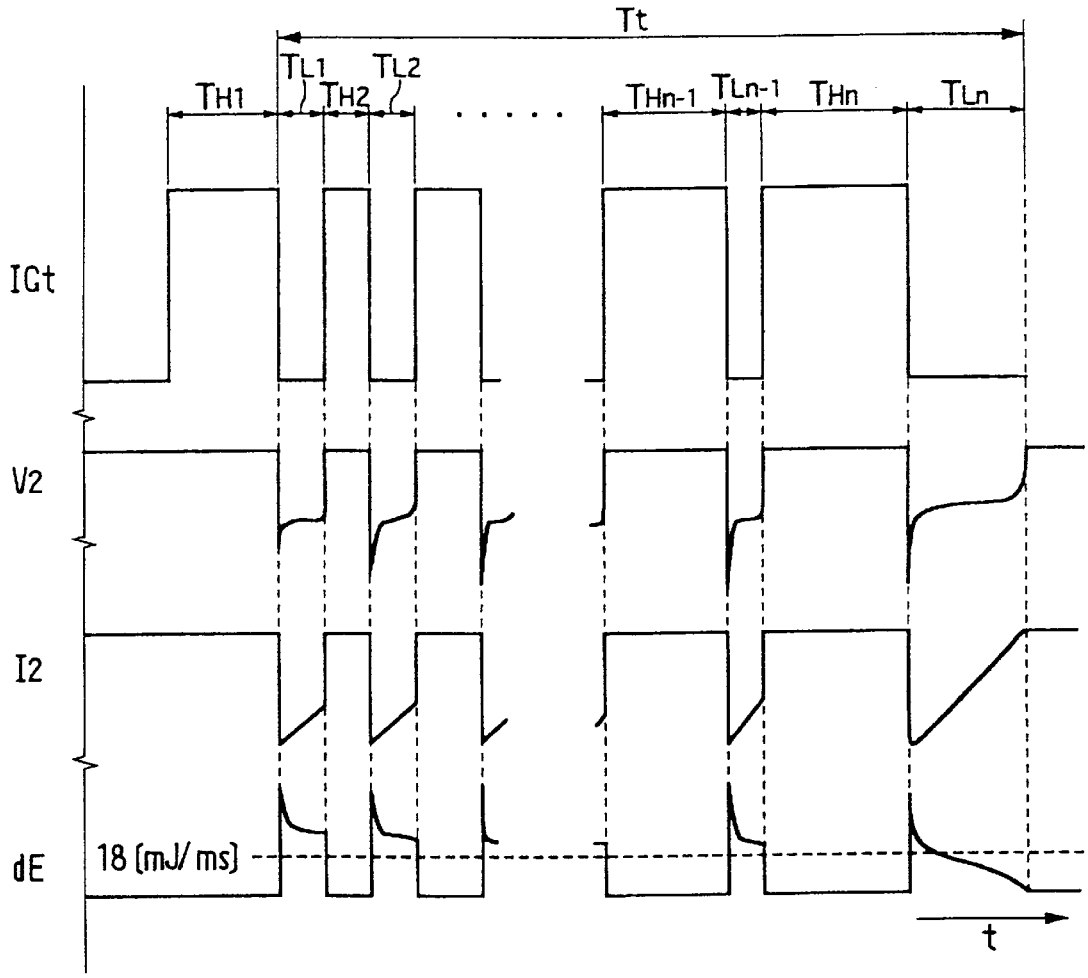
FIG. 9 is a time chart, in one embodiment, showing another variation of the state of transition of ignition signal, secondary voltage, secondary current, and discharging energy density under the combustion of stratified mixture.

Furthermore, the intermittent period TH2, . . . , THn in the total discharge period Tt for multiple discharge may be set so that the intermittent discharge period will become gradually longer as it approaches the latter half of the period as shown in FIG. 9 which gives another variation of the time chart of FIG. 5. Here, it is conceivable that when the discharge period TL1, . . . , TLn is longer than the intermittent period TH2, THn, almost all the ignition energy stored in the ignition coil is discharged at each time of single discharge, and therefore storage of the ignition energy will fail to keep up with discharge. To resolve this problem, the first half of the discharge period is set short so as to stop discharge before discharging all of the ignition energy stored in the ignition coil 25, thereby enabling to decrease the amount of ignition energy to be stored during the intermittent period TH. Thus it becomes possible to store a sufficient amount of discharge energy for igniting the sprayed fuel even immediately before the end of multiple discharge during stratified charge combustion, and, accordingly, to achieve a satisfactory discharge energy density dE of 18 [mJ/ms] or higher required for multiple discharge during each discharge period TL1, . . . , TLn.

As the operating condition parameter for use in changing from multiple discharge to single discharge or vice versa and in calculating the total discharge period Tt, each discharge period TL, and each intermittent period TH for multiple discharge, only the engine speed NE may be used. That is, when multiple discharge which is effective for stratified charge combustion is accomplished at an engine speed inclusive of the operating conditions for stratified charge combustion, multiple discharge is carried out also in the operation for non-stratified charge combustion which inherently requires no multiple discharge. In this case, however, there is such an advantage that controls can be simplified.

Next, explained below is the relationship between the length of spark gap G (hereinafter referred to simply as the "plug gap G") of the spark plug 19 mounted in the direct injection-type engine of the present embodiment and the discharge energy density required for ignition of the sprayed fuel by a spark generated at the plug gap G.

Figure 11:
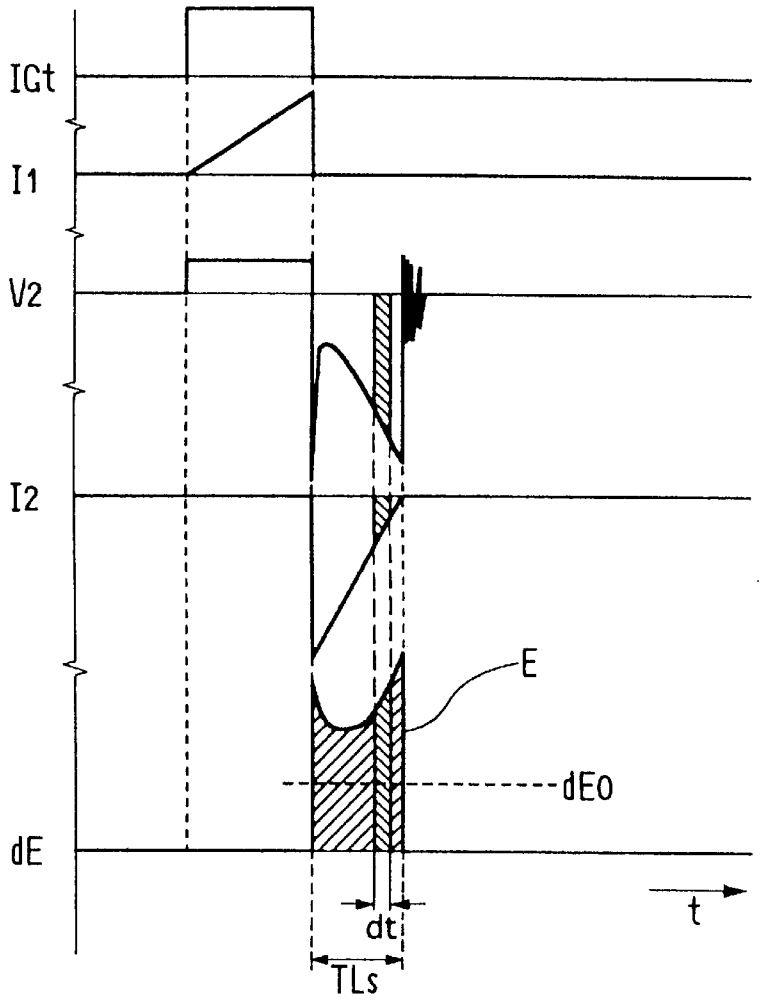
FIG. 11 is a time chart showing the state of transition of ignition signal, secondary voltage, secondary current, and discharge energy density when the plug gap of the spark plug is set wider than the plug gap in FIG. 10.
Figure 10:
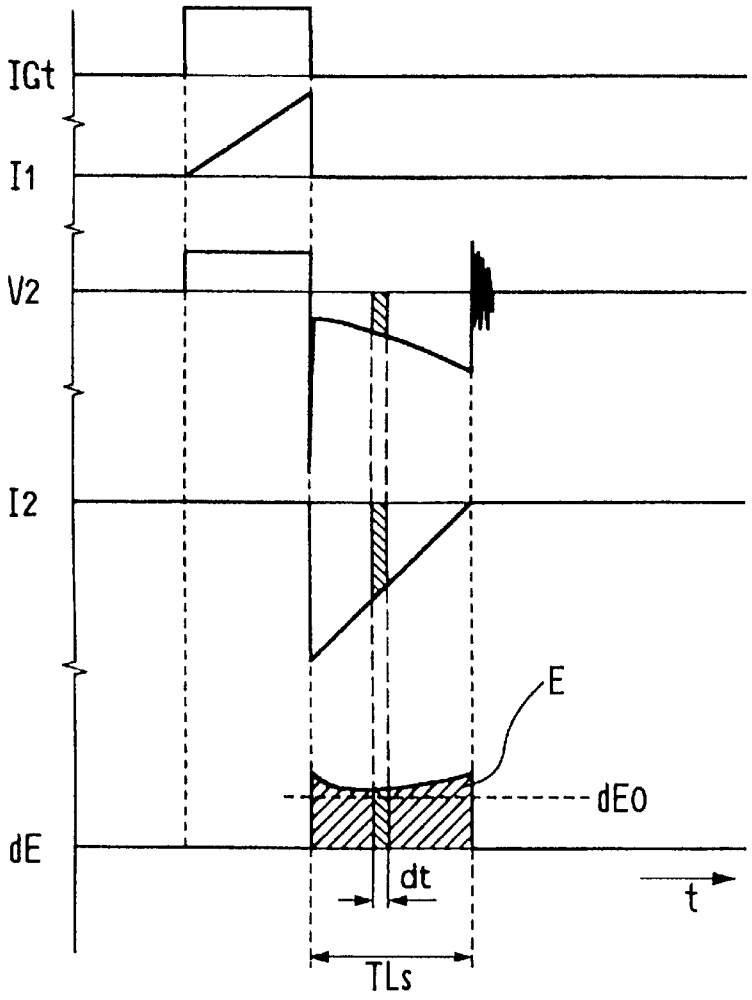
FIG. 10 is a time chart, in the embodiment, showing the state of transition of ignition signal, secondary voltage, secondary current, and discharging energy density when the plug gap of the spark plug is properly set for single discharge within the non-stratified charge combustion range.

FIG. 10 and FIG. 11 are time charts showing the state of transition of the ignition signal IGt, secondary voltage V2, secondary current I2, and discharge energy density dE during single discharge within the non-stratified charge combustion range in the direct injection-type engine 10 of the present embodiment. In FIG. 11, the spark plug 19 is provided with a wider plug gap G than that in FIG. 10.

As shown in FIG. 10 and FIG. 11, the ignition signal IGt is outputted from the ECU 30 to the power transistor 27 during single discharge. During the period when the ignition signal IGt reaches a high level, the power transistor 27 is energized to allow the primary current I1 to flow from the battery 26 to the primary winding 25*a* of the ignition coil 25, storing the ignition energy thereat. Then at a falling point where the ignition signal IGt falls to a low level, the power transistor 27 is turned off, allowing the discharge of the ignition energy stored in the ignition coil 25 through the secondary winding 25*b*. Thus, the secondary current I2 flows to apply the secondary voltage V2, which is a high voltage, to the spark plug 19.

In FIG. 10, the plug gap G of the spark plug 19 is properly set. As for the discharge energy density dE (=I2×V2) for single discharge, a discharge energy density dEo necessary for ignition from the start of discharge till the end of discharge is satisfied as the lower limit for igniting the sprayed fuel by a spark in accordance with the operating conditions of the direct injection-type engine.

In FIG. 11, however, because the plug gap G of the spark plug 19 is set wider than that in FIG. 10, the discharge energy density dE (=I2×V2) from the start to end of discharge largely exceeds the discharge energy density dEo necessary for ignition. The excessive portion of the discharge energy density dE is wasted. Since the discharge energy density E (=∫(I2×V2) dt) indicated by a diagonally shaded area in FIG. 10 is equal to that in FIG. 11, the discharge period TLs from the start of discharge till the end of discharge is short in FIG. 11. Therefore, depending upon the operating conditions, a proper spark generating timing for ignition cannot be achieved, which becomes a factor of such a disadvantage as a misfiring.

Figure 13:
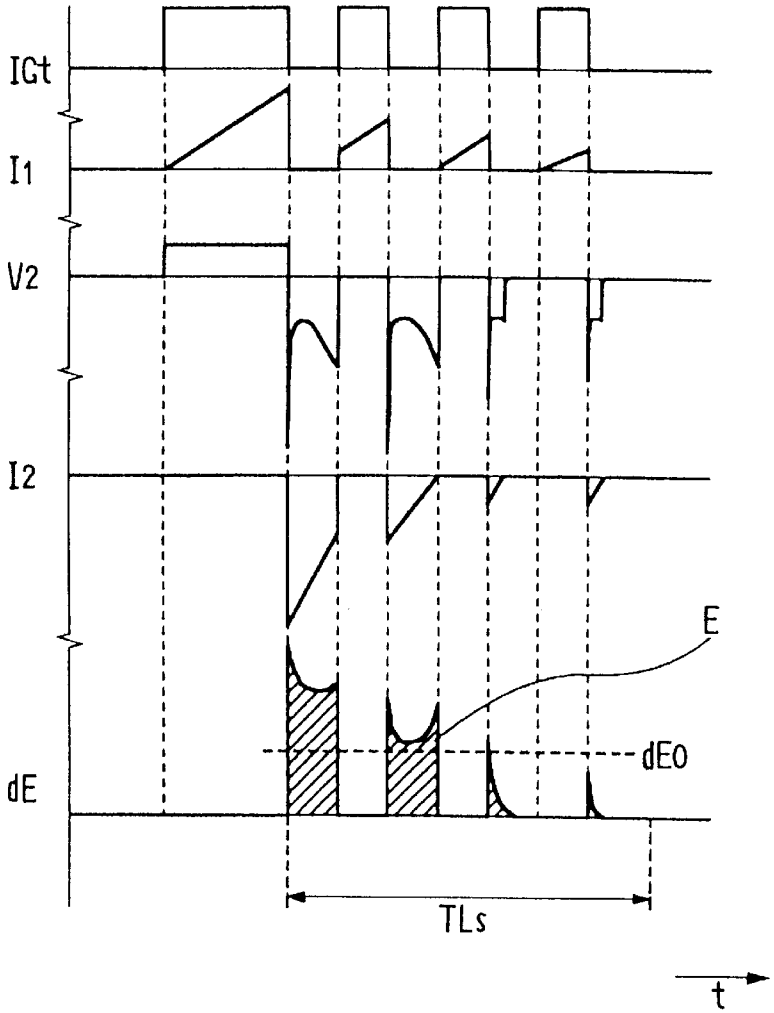
FIG. 13 is a time chart showing the state of transition of ignition signal, secondary voltage, secondary current, and discharge energy density when the plug gap of the spark plug is set wider than the plug gap in FIG. 12.
Figure 12:
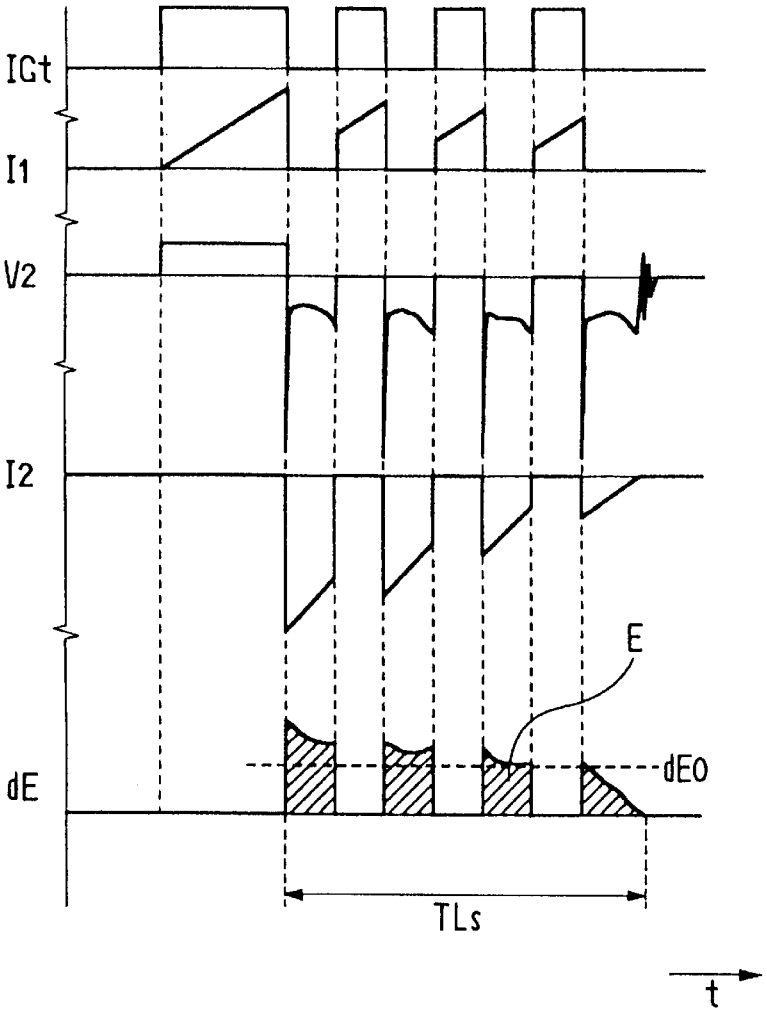
FIG. 12 is a time chart, in the embodiment, showing the state of transition of ignition signal, secondary voltage, secondary current, and discharge energy density when the plug gap of the spark plug is properly set for multiple discharge within the stratified charge combustion range.

FIG. 12 and FIG. 13 are time charts showing the state of transition of the ignition signal IGt, secondary voltage V2, secondary current I2, and discharge energy-density dE during multiple discharge within the range of stratified charge combustion in the direct injection-type engine 10 according to the present embodiment. In FIG. 13, the plug gap G of the spark plug 19 is set wider than that of FIG. 12.

As shown in FIGS. 12 and 13, the ignition signal IGt is outputted from the ECU 30 to the power transistor 27 during multiple discharge. During the period when the ignition signal IGt reaches the high level, the power transistor 27 is energized to admit the flow of the primary current I1 from the battery 26 to the primary winding 25*a*, where the ignition energy is stored. At the falling point where the ignition signal IGt falls to the low level, the power transistor 27 is turned off, discharging the ignition energy stored in the ignition coil 25 via the secondary winding 25, from which the secondary current I2 flows, applying to the spark plug 19 the secondary voltage V2 which is a high voltage.

In FIG. 12, the plug gap G of the spark plug 19 is properly set. As for the discharge energy density dE (=I2×V2) for multiple discharge, a discharge energy density dEo necessary for ignition from the start of discharge till the end of discharge, as the lower limit for igniting the sprayed fuel by a spark in accordance with the operating conditions of the direct injection-type engine, is satisfied.

In the meantime, in FIG. 13, since the plug gap G of the spark plug 19 is set wider than that in FIG. 12, the discharge energy density dE (=I2×V2) from the start of discharge till the end of discharge largely exceeds the discharge energy density required for ignition during the initial period of discharge, and is less than the discharge energy density required for ignition during the final discharge period. The discharge energy E (=∫(I2×V2)dt) indicated by a diagonally shaded area in FIG. 12 is equal to that shown in FIG. 13. In FIG. 13, therefore, during the initial period of discharge ranging from the start of discharge till the end of discharge, the discharge energy is supplied to waste, and near the end of discharge the discharge energy becomes insufficient, resulting in a shortened discharge period. The timing to generate a spark for ignition cannot be obtained under some operating conditions, resulting in such a disadvantage as a misfiring.

Next described is a relationship between the plug gap G and various parameters, to thereby properly specify the plug gap G of the spark plug 19 for the purpose of achieving a proper discharge energy density required for ignition during a predetermined discharge period.

Figure 14A:
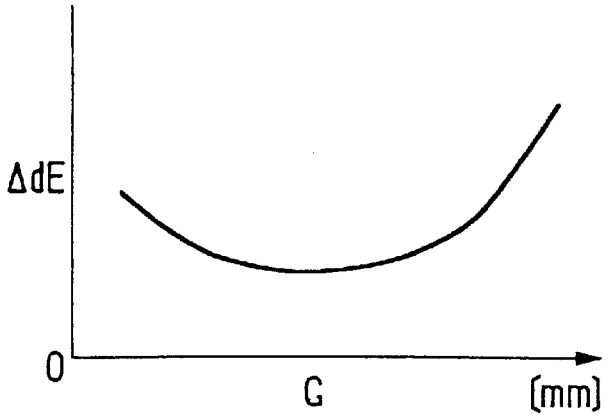
FIGS. 14A and 14B are characteristics diagram, in the embodiment, showing a relationship between the plug gap of the spark plug and the amount of variation in the discharge energy density.
Figure 14B:
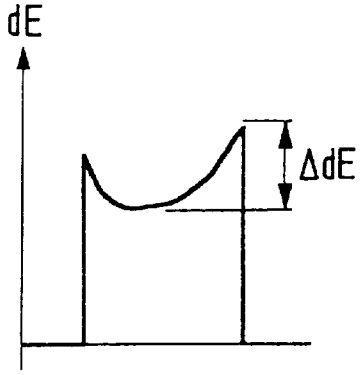

FIG. 14A is a characteristic diagram showing the amount of variation in the discharge energy density-relative to the plug gap G [mm]. FIG. 14B is an explanatory view giving the definition of the amount of variation in the discharge energy density. As shown in FIG. 14B, let a difference from the lower limit of the discharge energy density dE in the discharge period be the amount of variation in discharge energy density ΔdE, and the plug gap G increases over, decreased below, the predetermined length as shown in FIG. 14A, with the result that the amount of variation in discharge energy density ΔdE tends to increase. Consequently, in the discharge period, as previously stated, the smaller the variation in the density, the more ideal discharge energy density is achievable while satisfying the discharge energy density required for ignition.

Figure 15A:
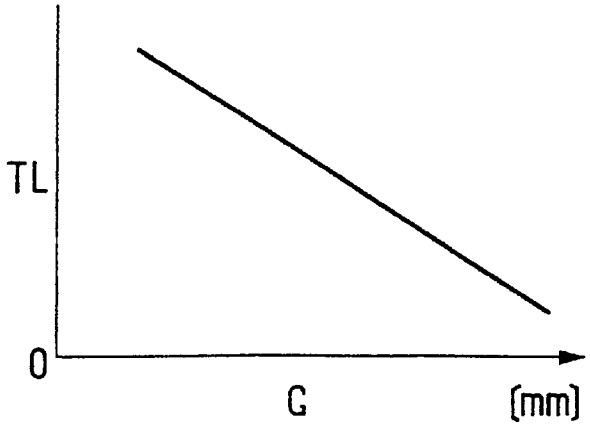
FIGS. 15A and 15B are characteristics diagrams showing a relationship between the plug gap of the spark plug used in one embodiment and the discharge maintaining period.
Figure 15B:
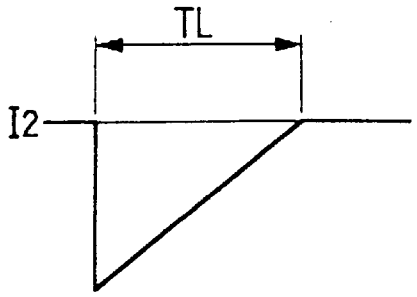

FIG. 15A is a characteristic diagram showing the discharge maintaining period in relation to the plug gap G [mm]. FIG. 15B is an explanatory view showing the definition of the discharge maintaining period. As shown in FIG. 15B, the discharge maintaining period is defined as the period ranging from the start of discharge till the end of discharge when the secondary current I2 flowing on the secondary winding 25*b* side of the ignition coil 25 gradually decreases to zero with the discharge of the discharge energy. Then, as shown in FIG. 15A, the electric resistance is prone to increase with the increase of the plug gap G, making it difficult to, perform aerial discharge and accordingly reducing the discharge maintaining period.

Figure 16A:
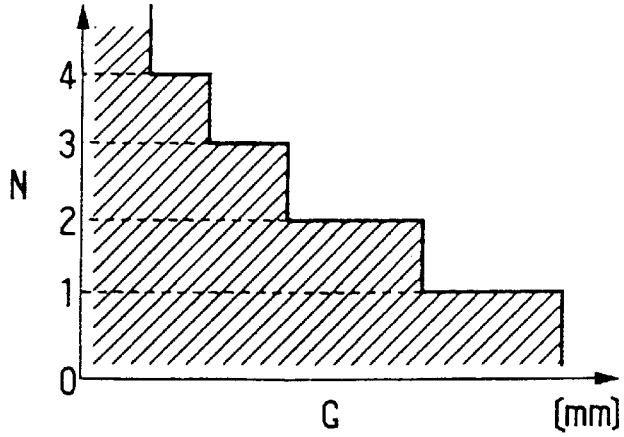
FIGS. 16A and 16B are characteristics diagrams showing a relationship between the plug gap of the spark plug used in one embodiment and the effective discharge maintaining frequency.
Figure 16B:
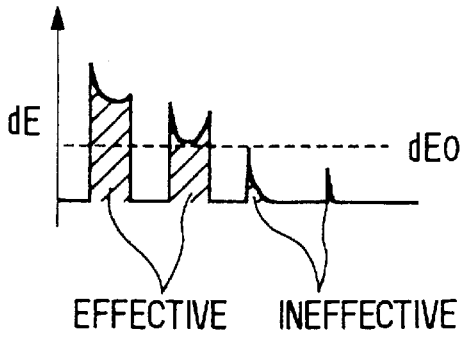

FIG. 16A is a characteristic diagram showing the effective discharge maintaining frequency N with respect to the plug gap G [mm], and FIG. 16B is an explanatory view showing effective and ineffective discharges. As shown in FIG. 16B, when the discharge .energy density dE during the predetermined discharge period exceeds the discharge energy density dEo which is required for ignition, a flame is produced by which the sprayed fuel is ignited properly, being counted as the effective discharge. On the other hand, as shown in FIG. 16B, when the discharge energy density dE is under the discharge energy density dEo required for ignition, and because of a short discharge period, a misfire will occur, resulting in an ineffective discharge. Then, as shown in FIG. 16A, because the effective discharge decreases with an increase in the plug gap G, the effective discharge maintaining frequency N as the usable range will decrease.

Figure 17:
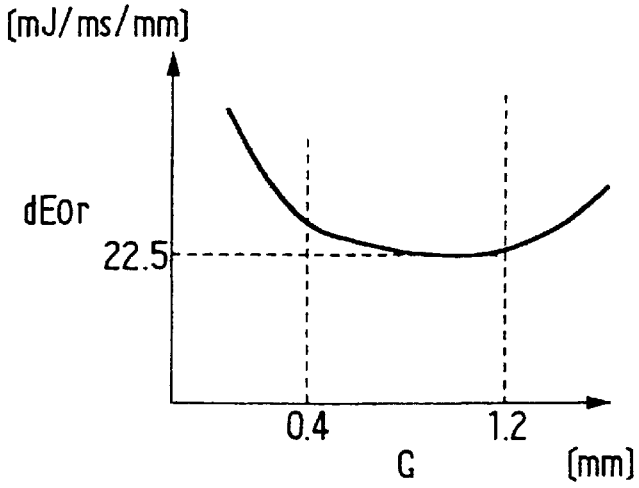
FIG. 17 is a characteristics diagram showing the relationship between the plug gap of the spark plug used in the embodiment and the discharge energy density per unit length of gap required for ignition.

It has been made clear by experimental work that if the plug gap G increases over 1.2 [mm] or decreases under 0.4 [mm], the discharge energy density dEor per unit gap length required for ignition is prone to excessively increase over the 22.5 [mJ/ms/mm] which is the lower limit thereof as shown in FIG. 17. Therefore, a desirable discharge energy is achieved by controlling the fluctuation of discharge energy variation while keeping 22.5 [mJ/ms/mm] which is the lower limit of the discharge energy density dEor per unit gap length necessary for ignition. When 22.5 [mJ/ms/mm] which is the lower limit of the discharge energy density per unit gap length necessary for ignition is kept for over 80 [%] of each discharge period of multiple discharge, the flame after igniting the sprayed fuel during each discharge of multiple discharge is kept on by continued combustion and will not be interrupted.

Figure 18:
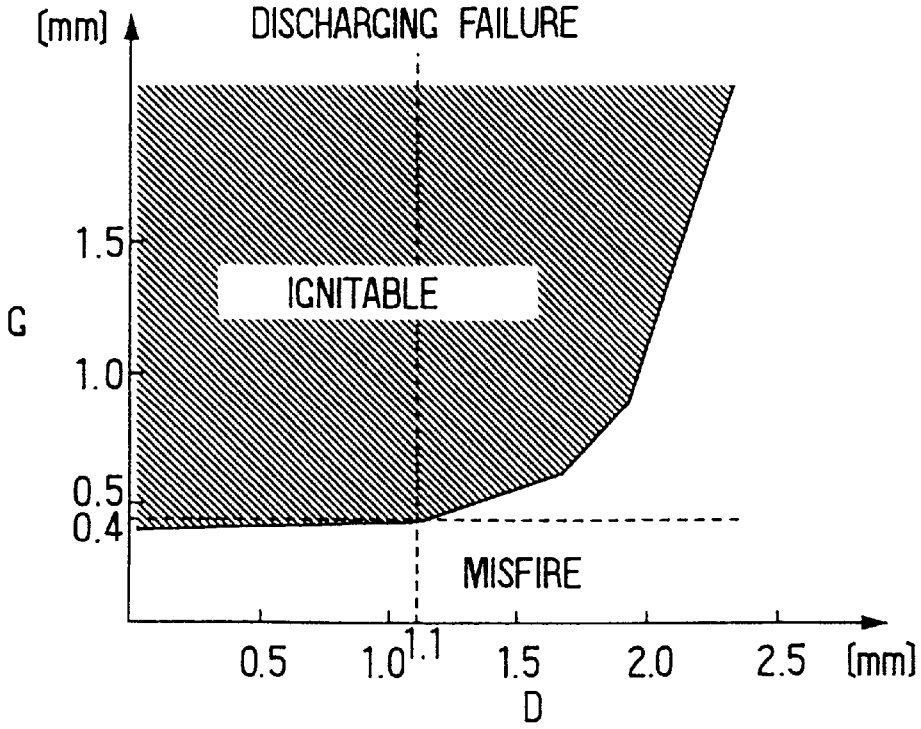
FIG. 18 is a characteristics diagram showing, as parameters, the center electrode diameter and the plug gap of the spark plug used in one embodiment within the ignitable range.
Figure 19:
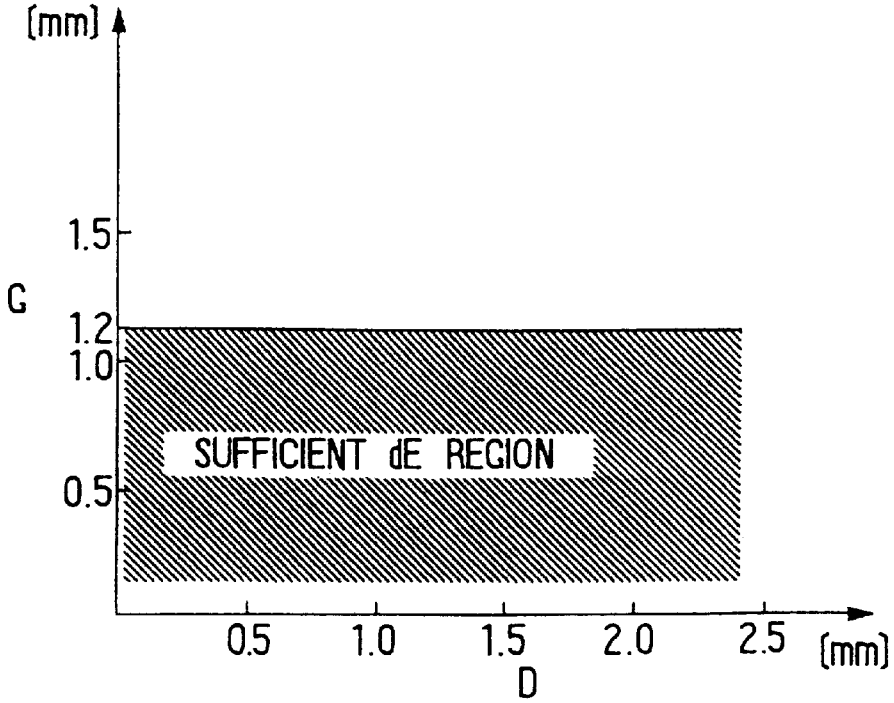
FIG. 19 is a characteristics diagram showing, as parameters, the center electrode diameter and the plug gap of the spark plug used in the embodiment within the range in which the discharge energy density required for ignition is achieved.

FIG. 18 is a characteristic diagram showing the ignitable region in the spark plug 19, using the center electrode diameter and the plug gap G as parameters. FIG. 19 is a characteristic diagram showing the discharge energy density achieving region required for ignition in the spark plug 19, using the center electrode diameter D and the spark plug G as parameters. In the ignitable region indicated by a diagonally shaded area in FIG. 18, when the-center electrode diameter D of the spark plug 19 is 1.1 [mm] or less and the plug gap G is 0.4 [mm] or over, a proper ignition is achieved unless the plug gap G is excessively increased, and accordingly there will occur neither a misfire nor a discharge failure. If, in this case, the plug gap G of the spark plug 19 decreases to less than 0.4 [mm], a spark generated is small and hard to ignite. On the other hand, if the plug gap G of the spark plug 19 is too large, the electrical resistance increases, failing to realize the aerial discharge. Furthermore; with an increase in the center electrode diameter D of the spark plug 19, sparks become liable to the cooling action of the electrode member, resulting in difficult formation of flames.

In the meantime, in the discharge energy density achieving region for ignition as indicated by the diagonally shaded area in FIG. 19, when the plug gap G is 1.2 [mm] or less, a sufficient discharge energy density for ignition is obtained almost without regard to the size (diameter) of the center electrode of the spark plug 19. If the plug gap G of the spark plug 19 becomes wider than 1.2 [mm] the discharge period decreases, making it difficult to realize multiple discharge. Therefore, in order to gain ideal discharge energy, the center electrode diameter of the spark plug 19 is set to 1.1 [mm] or less, and the plug gap G within the range of 0.4 to 1.2 [mm]. The center electrode diameter D of a spark plug 19 in actual use is decided with durability and productivity of a material of the center electrode 19*a* taken into consideration.

The spark ignition device of the present embodiment is set so that the discharge energy density per unit gap length of the plug gap G of the spark plug 19 will be 22.5 [mJ/ms/mm] in each discharge period TL1, . . . , TLn of the total discharge period Tt for multiple discharge. In the spark ignition device of the present embodiment, the center electrode diameter of the spark plug 19 is set at 1.1 [mm] or less, and the gap plug G is also set within the range of 0.4 to 1.2 [mm].

Therefore, in each discharge period of the multiple discharge, the discharge energy density for ignition by a spark generated at the plug gap G of the spark plug 19 is satisfied. The spark is generated to the fuel sprayed at a proper timing in accordance with specific operating conditions, to thereby insure reliable ignition to the sprayed fuel. Furthermore, even when the combustible mixture is present around the spark plug 19 at varied timings, the discharge energy density necessary for ignition is satisfied, which can realize stabilized combustion by supplying an air-fuel mixture more on the lean side than the theoretical air-fuel ratio, thereby attaining improved fuel efficiency.

What is claimed is:

1. A spark ignition device in a direct injection-type engine in which fuel is directly injected into each cylinder, comprising:

a spark plug mounted on each cylinder of the direct injection-type engine;

an ignition coil for applying a high voltage to generate a spark at the spark plug at an ignition timing; and ignition control means for intermittently applying the high voltage from the ignition coil two or more times, wherein the ignition control means generates multiple discharges at the spark plug at least in a part of operating conditions for stratified charge combustion, wherein the ignition control means calculates a changeover between multiple discharge and single discharge, total discharge period from start to end of multiple discharge, each discharge period, each intermittent period on the basis of a control map in which those are preset by each operating condition of the direct injection-type engine, and wherein the total discharge period of the multiple discharge is set within the range of 1.0 to less than 3.0 ms.

2. A spark ignition device as in claim 1, wherein each discharge period of the multiple discharge is set within the range of 0.05 to 0.5 ms.

3. A spark ignition device as in claim 2, wherein each intermittent period of the multiple discharge is set within the range of 0.1 to 1.0 ms.

4. A spark ignition device as in claim 2, wherein each intermittent period of the multiple discharge is so set as to gradually increase in each ignition cycle.

5. A spark ignition device as in claim 1, wherein each intermittent period of the multiple discharge is set within the range of 0.1 to 1.0 ms.

6. A spark ignition device as in claim 5, wherein each intermittent period of the multiple discharge is so set as to gradually increase in each ignition cycle.

7. A spark ignition device as in claim 1, wherein each intermittent period of the multiple discharge is so set as to gradually increase in each ignition cycle.

8. A spark ignition device in a direct injection-type engine in which fuel is directly injected into each cylinder, comprising:

a spark plug mounted on each cylinder of the direct injection-type engine;

an ignition coil for applying a high voltage to generate a spark at the spark plug at an ignition timing; and ignition control means for intermittently applying the high voltage from the ignition coil two or more times, wherein the ignition control means generates multiple discharges at the spark plug at least in a part of operating conditions for stratified charge combustion, wherein the ignition control means calculates a changeover between multiple discharge and single discharge, total discharge period from start to end of multiple discharge, each discharge period, each intermittent period on the basis of a control map in which those are preset by each operating condition of the direct injection-type engine, and wherein each discharge period of the multiple discharge is set within the range of 0.05 to 0.5 ms.

9. A spark ignition device in a direct injection-type engine in which fuel is directly injected into each cylinder, comprising:

a spark plug mounted on each cylinder of the direct injection-type engine;

an ignition coil for applying a high voltage to generate a spark at the spark plug at an ignition timing; and ignition control means for intermittently applying the high, voltage from the ignition coil two or more times, wherein the ignition control means generates multiple discharges at the spark plug at least in a part of operating conditions for stratified charge combustion, wherein the ignition control means calculates a changeover between multiple discharge and single discharge, total discharge period from start to end of multiple discharge, each discharge period, each intermittent period on the basis of a control map in which those are preset by each operating condition of the direct injection-type engine, and wherein each intermittent period of the multiple discharge is set within the range of 0.1 to 1.0 ms.

10. A spark ignition device in a direct injection-type engine in which fuel is directly injected into each cylinder, comprising:

a spark plug mounted on each cylinder of the direct injection-type engine;

an ignition coil for applying a high voltage to generate a spark at the spark plug at an ignition timing; and ignition control means for intermittently applying the high voltage from the ignition coil two or more times, wherein the ignition control means generates multiple discharges at the spark plug at least in a part of operating conditions for stratified charge combustion, wherein the ignition control means calculates a changeover between multiple discharge and single discharge, total discharge period from start to end of multiple discharge, each discharge period, each intermittent period on the basis of a control map in which those are preset by each operating condition of the direct injection-type engine, and wherein each intermittent period of the multiple discharge is so set as to gradually increase in each ignition cycle.

11. A spark ignition device in a direct injection-type engine in which fuel is directly injected into each cylinder, comprising:

a spark plug mounted on each cylinder of the direct injection-type engine;

an ignition coil for applying a high voltage to generate a spark at the spark plug at an ignition timing; and ignition control means for intermittently applying the high voltage from the ignition coil two or more times, wherein the ignition control means generates multiple discharges at the spark plug at least in a part of operating conditions for stratified charge combustion, wherein the ignition control means calculates a changeover between multiple discharge and single discharge, total discharge period from start to end of multiple discharge, each discharge period, each intermittent period on the basis of a control map in which those are preset by each operating condition of the direct injection-type engine, and wherein discharge energy density in each discharge period of the total discharge period of the multiple discharge is so set as to be 18 mJ/ms and over.

12. A spark ignition device in a direct injection-type engine in which fuel is directly injected into each cylinder, comprising:

a spark plug mounted on each cylinder of the direct injection-type engine;

an ignition coil for applying a high voltage to generate a spark at the spark plug at an ignition timing; and ignition control means for intermittently applying the high voltage from the ignition coil two or more times, wherein the ignition control means generates multiple discharges at the spark plug at least in a part of operating conditions for stratified charge combustion, wherein the ignition control means calculates a changeover between multiple discharge and single discharge, total discharge period from start to end of multiple discharge, each discharge period, each intermittent period on the basis of a control map in which those are preset by each operating condition of the direct injection-type engine, wherein each intermittent period of the multiple discharge is set within the range of 0.1 to 1.0 ms, and wherein the multiple discharge period is regarded as the intermittent period for the multiple discharge at the time the discharge energy density has decreased to less than 18 mJ/ms even when the discharge is being continued.

13. A spark ignition device in a direct injection-type engine in which fuel is directly injected into each cylinder, comprising:

a spark plug mounted on each cylinder of the direct injection-type engine;

an ignition coil for applying a high voltage to generate a spark at the spark plug at an ignition timing; and ignition control means for intermittently applying the high voltage from the ignition coil two or more times, wherein the ignition control means generates multiple discharges at the spark plug at least in a part of operating conditions for stratified charge combustion, wherein the ignition control means calculates a changeover between multiple discharge and single discharge, total discharge period from start to end of multiple discharge, each discharge period, each intermittent period on the basis of a control map in which those are preset by each operating condition of the direct injection-type engine, and wherein the discharge energy density per unit gap length of a plug gap of the spark plug during each discharge period of the total discharge period of the multiple discharge is set to be more than 22.5 mJ/ms/mm.

14. A spark ignition device as in claim 13, wherein, in the spark plug, a center electrode diameter is set to be less than 1.1 mm and a plug gap is set to be within the range of 0.4 to 1.2 mm.

15. A spark ignition device as in claim 13, wherein the discharge energy density per unit gap length of the plug gap of the spark plug is set to be more than 22.5 mJ/ms/mm at more than 80% with respect to each discharge period of the multiple discharge.

16. A spark ignition device in a direct injection-type engine in which fuel is directly injected into each cylinder, comprising:

a spark plug mounted on each cylinder of the direct injection-type engine;

an ignition coil for applying a high voltage to generate a spark at the spark plug at an ignition timing; and ignition control means capable of intermittently applying the high voltage from the ignition coil two or more times, wherein the ignition control means generates multiple discharges at the spark plug at least in a part of operating conditions for stratified charge combustion, and wherein, in the ignition control means, the intermittent period between discharges is so set as to gradually increase in each ignition cycle during the total discharge period from the start to end of multiple discharge.

* * * * *

UNITED STATES PATENT AND TRADEMARK OFFICE

CERTIFICATE OF CORRECTION

PATENT NO. : 6,397,827 B1
DATED : June 4, 2002
INVENTOR(S) : Kato et al.

It is certified that error appears in the above-identified patent and that said Letters Patent is hereby corrected as shown below:

Title page,
The assignee information should appear as follows:

-- [73] Assignee: Nippon Soken, Inc., Nishio-city (JP)
Denso Corporation, Kariya-city (JP) --

Signed and Sealed this

Twenty-seventh Day of May, 2003

JAMES E. ROGAN
*Director of the United States Patent and Trademark Office*